US011060767B2

(12) United States Patent
Fredslund et al.

(10) Patent No.: US 11,060,767 B2
(45) Date of Patent: Jul. 13, 2021

(54) METHOD FOR SWITCHING COMPRESSOR CAPACITY

(71) Applicant: Danfoss A/S, Nordborg (DK)

(72) Inventors: Kristian Fredslund, Haderslev (DK); Jan Prins, Nordborg (DK); Kenneth Madsen, Ry (DK); Frede Schmidt, Sonderborg (DK)

(73) Assignee: DANFOSS A/S, Nordborg (DK)

( * ) Notice: Subject to any disclaimer, the term of this patent is extended or adjusted under 35 U.S.C. 154(b) by 485 days.

(21) Appl. No.: 15/771,199

(22) PCT Filed: Oct. 31, 2016

(86) PCT No.: PCT/EP2016/076214
§ 371 (c)(1),
(2) Date: Apr. 26, 2018

(87) PCT Pub. No.: WO2017/076798
PCT Pub. Date: May 11, 2017

(65) Prior Publication Data

US 2018/0313581 A1 Nov. 1, 2018

(30) Foreign Application Priority Data

Nov. 5, 2015 (DK) ..... PA 201500691

(51) Int. Cl.
*F25B 1/10* (2006.01)
*F25B 41/385* (2021.01)
(Continued)

(52) U.S. Cl.
CPC ..... *F25B 1/10* (2013.01); *F25B 9/08* (2013.01); *F25B 41/20* (2021.01); *F25B 41/385* (2021.01);
(Continued)

(58) Field of Classification Search
CPC ..... F25B 41/043; F25B 2341/066; F25B 2341/0661; F25B 2341/0662;
(Continued)

(56) References Cited

U.S. PATENT DOCUMENTS 9,217,590 B2 * 12/2015 Cogswell ..... F25B 41/043
2008/0134701 A1 * 6/2008 Christensen ..... F25B 31/002 62/193
(Continued)

FOREIGN PATENT DOCUMENTS

CN 1955615 A 5/2007
CN 101354198 A 1/2009
(Continued)

OTHER PUBLICATIONS

International Search Report for PCT Serial No. PCT/EP2016/076214 dated Jan. 24, 2017.

*Primary Examiner* — Edward F Landrum
*Assistant Examiner* — Daniel C Comings
(74) *Attorney, Agent, or Firm* — McCormick, Paulding & Huber PLLC

(57) ABSTRACT

A method for operating a compressor unit (2) comprising one or more compressors (8, 9, 10) is disclosed, the compressor unit (2) being arranged in a vapour compression system (1). Two or more options for distributing the available compressor capacity of the compressor unit (2) between being connected to a high pressure suction line (11) and to a medium pressure suction line (13) are defined. For each option, an expected impact on one or more operating parameters of the vapour compression system (1), resulting from distributing the available compressor capacity according to the option, is predicted. An option is selected, based on the predicted expected impact for the options, and based on current operating demands of the vapour compression system (1), and the available compressor capacity is distributed
(Continued)

according to the selected option, e.g. by means of settings of one or more valve arrangements (14, 15).

16 Claims, 1 Drawing Sheet

(51) Int. Cl.
*F25B 41/39* (2021.01)
*F25B 41/20* (2021.01)
*F25B 9/08* (2006.01)

(52) U.S. Cl.
CPC ..... *F25B 41/39* (2021.01); *F25B 2341/0012* (2013.01); *F25B 2400/16* (2013.01); *F25B 2400/23* (2013.01); *F25B 2500/18* (2013.01); *F25B 2500/19* (2013.01); *F25B 2600/2507* (2013.01); *F25B 2600/2519* (2013.01); *F25B 2600/2523* (2013.01)

(58) Field of Classification Search
CPC ..... F25B 2600/2507; F25B 2600/2519; F25B 2600/2523; F25B 41/385; F25B 41/39; F25B 2341/0012; F25B 2500/18; F25B 2500/19; F25B 2400/16; F25B 2400/23
See application file for complete search history.

(56) References Cited

U.S. PATENT DOCUMENTS

| | | | | |
|---|---|---|---|---|
| 2013/0036757 | A1* | 2/2013 | Okaichi | F25B 1/10 62/196.1 |
| 2013/0220589 | A1* | 8/2013 | Liu | F24F 11/83 165/253 |

FOREIGN PATENT DOCUMENTS

| | | | | |
|---|---|---|---|---|
| GB | 888446 | A | 1/1962 | |
| GB | 2017890 | A | 10/1979 | |
| GB | 2518559 | A | 3/2015 | |
| WO | 2008/140454 | A1 | 11/2008 | |
| WO | 2013/169591 | A1 | 11/2013 | |
| WO | 2013/174379 | A1 | 11/2013 | |
| WO | WO 2015/039688 | A1 * | 3/2015 | F25B 43/00 |

* cited by examiner

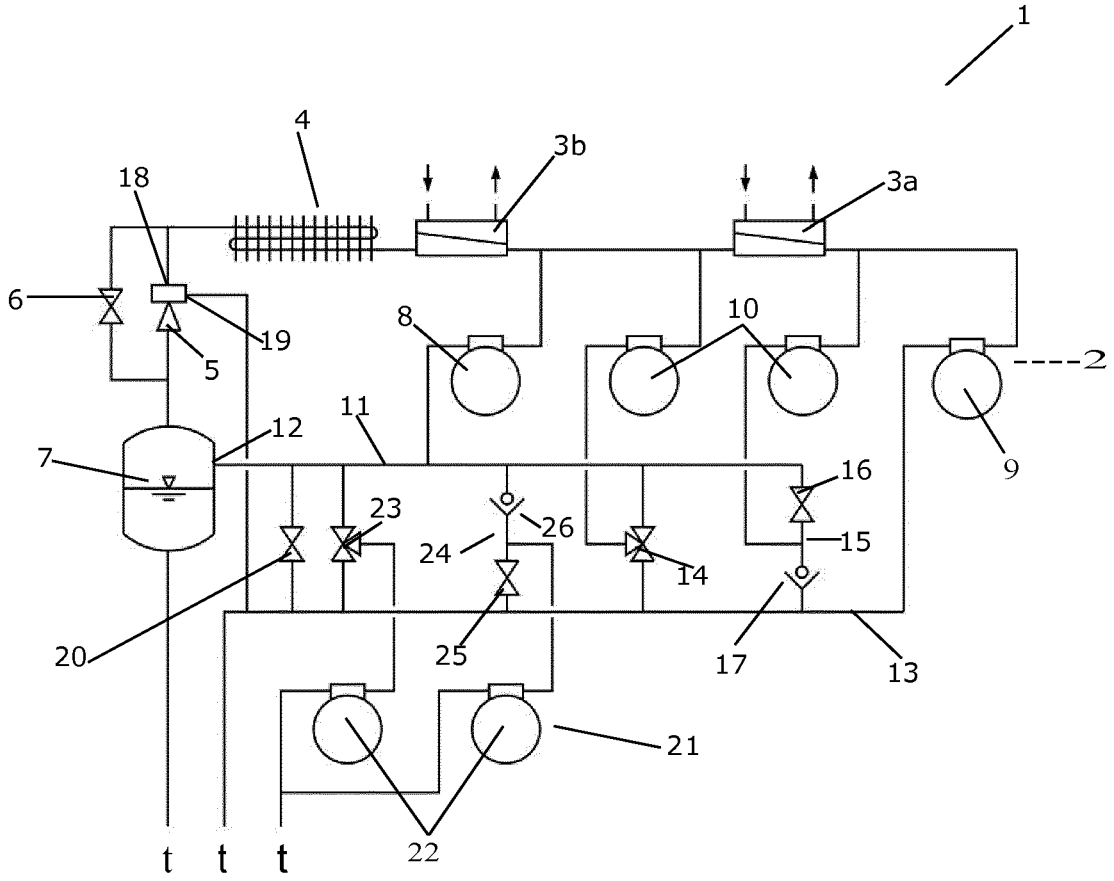
1
4
3b
3a
18
6
19
5
8
10
2
11
12
7
9
16
23
26
24
15
14
20
25
17
13
21
22
t
t
t

METHOD FOR SWITCHING COMPRESSOR CAPACITY

CROSS-REFERENCE TO RELATED APPLICATIONS

This application is a national stage application of International Patent Application No. PCT/EP2016/076214, filed on Oct. 31, 2016, which claims priority to Danish patent application no. PA 2015 00691, filed on Nov. 5, 2015, each of which is hereby incorporated by reference in its entirety.

TECHNICAL FIELD

The present invention relates to a method for operating a compressor unit comprising one or more compressors, the compressor unit being arranged in a vapour compression system. According to the method of the invention, the compressor unit is operated to switch available compressor capacity between being connected to a high pressure suction line and to a medium pressure suction line. The method further relates to a vapour compression system comprising a switchable compressor unit.

BACKGROUND

In some refrigeration systems, a high pressure valve and/or an ejector is arranged in a refrigerant path, at a position downstream relative to a heat rejecting heat exchanger. Thereby refrigerant leaving the heat rejecting heat exchanger passes through the high pressure valve or the ejector, and the pressure of the refrigerant is thereby reduced. Furthermore, the refrigerant leaving the high pressure valve or the ejector will normally be in the form of a mixture of liquid and gaseous refrigerant, due to the expansion taking place in the high pressure valve or the ejector. This is, e.g., relevant in vapour compression systems in which a transcritical refrigerant, such as $CO_2$, is applied, and where the pressure of refrigerant leaving the heat rejecting heat exchanger is expected to be relatively high.

The refrigerant passing through the high pressure valve or the ejector is received in a receiver, where the refrigerant is separated into a liquid part and a gaseous part. The gaseous part of the refrigerant may be supplied directly to a compressor unit, via a high pressure suction line. The liquid part of the refrigerant is normally supplied to an evaporator, via an expansion device, and the refrigerant leaving the evaporator is supplied to the compressor unit, via a medium pressure suction line. Accordingly, the compressors of the compressor unit may receive gaseous refrigerant from the receiver, via the high pressure suction line and/or from the evaporator, via the medium pressure suction line.

The refrigerant supplied to the compressor unit via the high pressure suction line has not been subjected to the pressure drop introduced in the expansion device arranged upstream relative to the evaporator. Thereby the work required by the compressor(s) of the compressor unit in order to compress the refrigerant received via the high pressure suction line is lower than the work required in order to compress the refrigerant received via the medium pressure suction line. It is therefore desirable to supply as much refrigerant as possible to the compressor unit via the high pressure suction line.

However, the amount of refrigerant being supplied to the compressor unit via the high pressure suction line and the medium pressure suction line, respectively, is variable, and it is therefore necessary to ensure that sufficient compressor capacity is available for each of the suction lines to meet the demand at any time. This may, e.g., be obtained by having a sufficiently high number of compressors connected to each of the suction lines to meet peak demands, and then only switching on the number of compressors which are required under the given circumstances. However, this solution results in a high amount of unused compressor capacity. As an alternative, one or more compressors of the compressor unit may be selectively connectable to the high pressure suction line or to the medium pressure suction line. This allows the compressor capacity of this compressor or these compressors to be shifted between being allocated for compressing refrigerant received via the high pressure suction line and being allocated for compressing refrigerant received via the medium pressure suction line, and the total available compressor capacity can thereby be utilized more efficiently.

In the case that one or more compressors of the compressor unit are selectively connectable as described above, it is desirable to be able to control the connection of the compressor(s) in a suitable manner which fulfils various requirements for the operation of the vapour compression system.

WO 2013/169591 A1 discloses an integrated $CO_2$ refrigeration and air conditioning system, comprising an AC compressor and a number of MT compressors. In the case of loss of the AC compressor, the refrigerant of the AC system can be supplied to the MT compressors, via a valve, thereby ensuring continuous operation of the AC system.

SUMMARY

It is an object of embodiments of the invention to provide a method for operating a compressor unit of a vapour compression system in a manner which ensures suitable distribution of the available compressor capacity, while taking various operating requirements of the vapour compression system into account.

It is a further object of embodiments of the invention to provide a method for operating a compressor unit of a vapour compression system in a manner which allows a distribution of the available compressor capacity to be changed in a fast manner.

It is an even further object of embodiments of the invention to provide a vapour compression system in which the available compressor capacity can be distributed in a suitable manner, while taking various operating requirements of the vapour compression system into account.

It is an even further object of embodiments of the invention to provide a vapour compression system in which the distribution of the available compressor capacity can be changed in a fast manner.

It is an even further object of embodiments of the invention to provide a vapour compression system in which the distribution of the available compressor capacity can be changed without requiring that one or more compressors are switched off.

According to a first aspect the invention provides a method for operating a compressor unit comprising one or more compressors, the compressor unit being arranged in a vapour compression system, the vapour compression system further comprising a heat rejecting heat exchanger, a high pressure expansion device, a receiver and at least one evaporator unit, each evaporator unit comprising an evaporator and an expansion device controlling a supply of refrigerant to the evaporator, each compressor of the compressor unit being connectable to a high pressure suction line and/or to a medium pressure suction line, the high pressure suction line interconnecting a gaseous outlet of the receiver and the compressor unit and the medium pressure suction line interconnecting an outlet of the evaporator unit(s) and the compressor unit, the method comprising the steps of:

a. defining two or more options for distributing the available compressor capacity of the compressor unit between being connected to the high pressure suction line and to the medium pressure suction line,
b. for each option, predicting an expected impact on one or more operating parameters of the vapour compression system, resulting from distributing the available compressor capacity according to the option,
c. selecting an option, based on the predicted expected impact for the options, and based on current operating demands of the vapour compression system, and
d. distributing the available compressor capacity according to the selected option.

The method according to the first aspect of the invention is for operating a compressor unit arranged in a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The compressor unit comprises one or more compressors arranged to compress refrigerant flowing in a refrigerant path of the vapour compression system.

The vapour compression system further comprises a heat rejecting heat exchanger, a high pressure expansion device, a receiver and at least one evaporator unit, arranged in the refrigerant path. The heat rejecting heat exchanger could, e.g., be in the form of a condenser, in which refrigerant is at least partly condensed, or in the form of a gas cooler, in which refrigerant is cooled, but remains in a gaseous or transcritical state.

The high pressure expansion device could, e.g., be in the form of an ejector or in the form of a high pressure valve. Alternatively, the high pressure expansion device could be or comprise an ejector as well as a high pressure valve arranged in parallel. This will be described in further detail below. In any event, refrigerant passing through the high pressure expansion device undergoes expansion, and the refrigerant leaving the high pressure expansion device will normally be in the form of a mixture of liquid and gaseous refrigerant.

Each evaporator unit comprises an evaporator and an expansion device controlling a supply of refrigerant to the evaporator. Thus, the supply of refrigerant to each evaporator can be controlled individually by means of the expansion device associated with the evaporator. The expansion device(s) may, e.g., be in the form of expansion valve(s).

Each compressor of the compressor unit is connectable to a high pressure suction line and/or to a medium pressure suction line. The high pressure suction line interconnects a gaseous outlet of the receiver and the compressor unit, and the medium pressure suction line interconnects an outlet of the evaporator unit(s) and the compressor unit. Thus, a compressor which is connected to the high pressure suction line receives refrigerant from the gaseous outlet of the receiver, and may be regarded as a 'receiver compressor'. Similarly, a compressor which is connected to the medium pressure suction line receives refrigerant from the outlet(s) of the evaporator(s), and may be regarded as a 'main compressor' or a 'medium temperature (MT) compressor'. A given compressor may be permanently connected to either the high pressure suction line or the medium pressure suction line. Alternatively or additionally, at least one compressor may be selectively connectable to the high pressure suction line or the medium pressure suction line, thereby allowing the compressor to operate selectively as a 'receiver compressor' or as a 'main compressor'. Thereby at least some of the available compressor capacity can be switched between these two functions or purposes.

Refrigerant flowing in the refrigerant path of the vapour compression system is compressed by the compressor(s) of the compressor unit. The compressed refrigerant is supplied to the heat rejecting heat exchanger, where heat exchange takes place with the ambient, or with a secondary fluid flow across the heat rejecting heat exchanger, in such a manner that heat is rejected from the refrigerant flowing through the heat rejecting heat exchanger. In the case that the heat rejecting heat exchanger is in the form of a condenser, the refrigerant is at least partly condensed when passing through the heat rejecting heat exchanger. In the case that the heat rejecting heat exchanger is in the form of a gas cooler, the refrigerant flowing through the heat rejecting heat exchanger is cooled, but remains in a gaseous or transcritical state.

From the heat rejecting heat exchanger, the refrigerant is supplied to the high pressure expansion device. As the refrigerant passes through the high pressure expansion device, the pressure of the refrigerant is reduced, and the refrigerant leaving the high pressure expansion device will normally be in the form of a mixture of liquid and gaseous refrigerant, due to the expansion taking place in the high pressure expansion device.

The refrigerant is then supplied to the receiver, where the refrigerant is separated into a liquid part and a gaseous part. The liquid part of the refrigerant is supplied to the evaporator unit(s), where the pressure of the refrigerant is reduced when passing through the expansion device(s), before the refrigerant is supplied to the evaporator(s). The refrigerant being supplied to the evaporator(s) is thereby in a mixed gaseous and liquid state. In the evaporator(s), the liquid part of the refrigerant is at least partly evaporated, while heat exchange takes place with the ambient, or with a secondary fluid flow across the evaporator(s), in such a manner that heat is absorbed by the refrigerant flowing through the evaporator(s). Finally, the refrigerant is supplied, via the medium pressure suction line, to the compressor(s) of the compressor unit which is/are connected to the medium pressure suction line.

The gaseous part of the refrigerant in the receiver may be supplied, via the high pressure suction line, directly to the compressor(s) of the compressor unit which is/are connected to the high pressure suction line. Thereby the gaseous refrigerant is not subjected to the pressure drop introduced by the expansion device(s), and energy is conserved, as described above Thus, at least a part of the refrigerant flowing in the refrigerant path is alternatingly compressed by the compressor(s) of the compressor unit and expanded by the expansion device(s), while heat exchange takes place at the heat rejecting heat exchanger and at the evaporator(s). Thereby cooling or heating of one or more volumes can be obtained.

According to the method of the first aspect of the invention two or more options for distributing the available compressor capacity of the compressor unit between being connected to the high pressure suction line and to the medium pressure suction line are defined. The various options could, e.g., include various settings or combinations of settings of one or more valve arrangements arranged to control whether a given compressor is connected to the high pressure suction line or to the medium pressure suction line.

Alternatively or additionally, the various options could include (discrete) speed settings for one or more variable speed compressors and/or settings defining whether or not each compressor of the compressor unit is operating or not.

Next, for each option, an expected impact on one or more operating parameters of the vapour compression system, resulting from distributing the available compressor capacity according to the option, is predicted. The operating parameters could, e.g., include energy efficiency of the vapour compression system, cooling capacity of one or more evaporators, wear on various parts of the vapour compression system, etc. Thus, it is predicted what is expected to happen with regard to one or more selected operating parameters, if a distribution of the available compressor capacity corresponding to a given option is selected. This will allow an operator or the system to select an option which provides the best operation of the vapour compression system, with respect to the operating parameter(s) which is/are considered most relevant or important. For instance, it may be desirable to select the option which provides the most energy efficient operation of the vapour compression system. However, this must not have the consequence that a required cooling demand can not be met. Furthermore, a less energy efficient option may be preferred, if this means significantly less wear one or more components of the vapour compression system, e.g. because switching on or off the compressors is reduced.

Accordingly, an option is then selected, based on the predicted expected impact for the options, and based on current operating demands of the vapour compression system. Finally, the available compressor capacity is distributed according to the selected option.

Thus, the available compressor capacity of the compressor unit is distributed among compressing refrigerant received from the gaseous outlet of the receiver, via the high pressure suction line, and compressing refrigerant received from the evaporator unit(s), via the medium pressure suction line, in a manner which is optimal with respect to one or more operating parameters.

The step of distributing the available compressor capacity according to the selected option may comprise switching one or more compressors from being connected to the medium pressure suction line to being connected to the high pressure suction line, or vice versa. According to this embodiment, the distribution of the available compressor capacity corresponding to the selected option differs from the distribution which is currently selected. Therefore it is necessary to shift some of the compressor capacity from being connected to the medium pressure suction line to being connected to the high pressure suction line, or vice versa, in order to reach the distribution which is specified by the selected option.

The step of switching one or more compressors may be performed without stopping the compressor(s). This is an advantage, because it is thereby possible to perform the switching fast, and a new option can be quickly selected if it turns out that this will be beneficial with respect to one or more operating parameters, or if the priority of the operating parameters changes. Furthermore, the wear caused to the compressors due to switching them on and off is avoided to the greatest possible extent.

The step of switching one or more compressors may comprise operating at least one valve arrangement arranged to selectively connect one of the compressors to the high pressure suction line or to the medium pressure suction line. According to this embodiment, one compressor is switched between being connected to the high pressure suction line and being connected to the medium pressure suction line, simply by operating a corresponding valve arrangement.

The valve arrangement may comprise a two-way valve arranged to connect the compressor to the high pressure suction line and a non-return valve arranged to connect the compressor to the medium pressure suction line. According to this embodiment, the valve arrangement is operated by operating the two-way valve. If the two-way valve is open, the compressor receives refrigerant from the high pressure suction line, and the non-return valve will automatically close, since the pressure prevailing in the high pressure suction line, and thereby at the inlet of the compressor, is higher than the pressure prevailing in the medium pressure suction line. If the two-way valve is closed, the refrigerant supply from the high pressure suction line to the compressor is prevented, and the non-return valve will open, thereby ensuring that the compressor receives refrigerant from the medium pressure suction line. One advantage of this valve arrangement is, that it is possible to switch the compressor between being connected to the high pressure suction line and the medium pressure suction line without having to stop the compressor. Furthermore, such a valve arrangement can be rapidly switched, thereby allowing the vapour compression system to react quickly to a change in operating conditions. For instance, the two-way valve may be operated in a pulse width modulating manner, thereby allowing the available compressor capacity to be distributed in any desirable manner. Finally, such a valve arrangement can be provided at low costs.

As an alternative, the valve arrangement may be or comprise a three-way valve.

The step of distributing the available compressor capacity according to the selected option may comprise switching one or more compressors of the compressor unit on or off. This may, e.g., be relevant in the case that one or more compressors of the compressor unit is/are permanently connected to the high pressure suction line or to the medium pressure suction line. Furthermore, the selected option may require an increase or a decrease in the total available compressor capacity of the compressor unit, i.e. in the currently operating compressor capacity, as compared to the current compressor capacity.

The one or more operating parameters of the vapour compression system may comprise energy consumption, mass flow distribution, cooling capacity, heat recovery, number of starts or stops of compressors, runtime equalization of compressors, and/or oil return to the compressor unit.

As described above, it is normally desirable to operate a vapour compression system in a manner which is as energy efficient as possible. However, the option which provides the most energy efficient operation of the vapour compression system may have an impact on one or more other operating parameters. For instance, additional starts or stops of the compressors may be required, or it may not be possible to provide a required cooling capacity. In such cases, an option which is less energy efficient may be selected, in order to avoid the disadvantages with respect to the other operating parameters. As another example, it may be revealed that the oil return to the compressors is insufficient. In this case an option which ensures sufficient oil return must be selected, at least for a limited period of time, regardless of the energy efficiency or impact on other operating parameters of that option. Similarly, if a heat recovery system requests a level of heat recovery, an option which provides the requested level of heat recovery may be selected, even if this is not the most energy efficient option.

The step of predicting an expected impact on one or more operating parameters of the vapour compression system may be performed using a model based approach.

As an alternative, the expected impact may be predicted by performing calculations.

The step of selecting an option may further be based on one or more expected future requirements for operating the vapour compression system, and the step of distributing the available compressor capacity according to the selected option may comprise switching a compressor which is currently not running from being connected to the high pressure suction line to being connected to the medium pressure suction line, or vice versa, in order to be able to meet the expected future requirements.

In some cases it may be expected that certain requirements for operating the vapour compression system may change in the near future. For instance, an increase or decrease in required cooling capacity, required heat recovery, ambient temperature, etc. may be expected. In this case it may be advantageous to ensure that a compressor, which is not currently running, is connected to a suction line which, when the compressor is switched on, will enable the compressor unit to meet the expected future requirements. This will have no influence on the current distribution of the available compressor capacity, since the compressor which is not running does not form part of the currently available compressor capacity. However, it is ensured that when the expected future requirements actually occur, the requirements can easily be met, simply by switching on the compressor.

The vapour compression system may further comprise a low temperature evaporator unit, a low temperature compressor unit having an inlet connected to an outlet of the low temperature evaporator unit, and a low temperature valve arrangement arranged to selectively interconnect an outlet of the low temperature compressor unit to the high pressure suction line or to the medium pressure suction line, and at least some of the options may define settings for the low temperature valve arrangement.

According to this embodiment the vapour compression system comprises a medium temperature part as well as a low temperature part. The medium temperature part may be adapted to provide cooling for medium temperature cooling display cases, e.g. providing a temperature inside the display cases of approximately 5° C. The low temperature part may be adapted to provide cooling for freezing purposes, or low temperature display cases, e.g. providing a temperature inside the display cases of approximately −18° C. In such systems the pressure of the refrigerant leaving the low temperature evaporator units is often initially compressed by a low temperature compressor unit, and subsequently mixed with the refrigerant leaving the medium temperature evaporator units before being further compressed by the medium temperature compressor unit.

However, according to this embodiment, it may be selected whether the discharge from the low temperature compressor unit is to be mixed with the refrigerant leaving the gaseous outlet of the receiver, i.e. refrigerant flowing in the high pressure suction line, or with the refrigerant leaving the medium temperature evaporator units, i.e. refrigerant flowing in the medium pressure suction line. For instance, the refrigerant flow from the gaseous outlet of the receiver towards the compressor unit may be insufficient to keep one of the compressors running. In this case, directing the discharge of the low temperature compressor unit towards the high pressure suction line may allow a sufficient refrigerant flow in the high pressure suction line to keep a compressor running. This will normally be more energy efficient than disconnecting all compressors from the high pressure suction line and directing the gaseous refrigerant from the receiver to the medium pressure suction line, via a bypass valve. Accordingly, it is advantageous to take settings of the low temperature valve arrangement into account when defining the various options.

Accordingly, the step of distributing the available compressor capacity may comprise operating the low temperature valve arrangement.

The step of defining two or more options for distributing the available compressor capacity may be performed on the basis of current and/or expected operating conditions of the vapour compression system. According to this embodiment, only options which make sense with regard to the current operating conditions, or expected operating conditions in the near future, are defined. Thereby prediction of the expected impact is only performed with respect to such options. This reduces the required processing power in order to perform the predictions. For instance, it may be known that an increase of heat recovery is required. In this case options which are known to have no impact on, or even to reduce, the heat recovery should not form part of the identified options.

The high pressure expansion device may be an ejector having a primary inlet connected to an outlet of the heat rejecting heat exchanger, an outlet connected to the receiver and a secondary inlet connected to the medium pressure suction line, and the method may further comprise the step of monitoring oil return to the compressors.

In vapour compression systems comprising an ejector, at least a part of the refrigerant leaving the evaporator is supplied to the secondary inlet of the ejector instead of to the compressor unit. Ideally, all of the refrigerant should be supplied to the secondary inlet of the ejector, and the compressor unit should only receive refrigerant via the high pressure suction line, because this is normally the most energy efficient way of operating the vapour compression system. However, this has the consequence that oil is not automatically returned to the compressors by the refrigerant. A situation may therefore occur, in which the oil level in the compressors becomes too low. It is therefore relevant to monitor the oil return to the compressors, in order to detect whether or not there is a risk that the oil level in the compressors becomes too low.

The step of monitoring oil return to the compressors could, e.g., include monitoring an oil level in an oil separator arranged in the refrigerant path between the compressor unit and the heat rejecting heat exchanger. In the case that this oil level decreases below a certain threshold value, it is an indication that the oil return to the compressors is insufficient. As an alternative, a frequency with which the oil separator returns oil to the compressors could be monitored. An increase in this frequency indicates that a too large amount of oil has accumulated in a part of the refrigerant path which does not include the compressors, and that the oil return is therefore insufficient. As another alternative, the step of monitoring oil return to the compressors could include monitoring an oil level in an oil accumulator inside one or more of the compressors. In the case that this oil level decreases below a certain threshold value, it is an indication that the oil return to the compressors is insufficient.

The step of selecting an option may comprise selecting an option in which at least one compressor is connected to the medium pressure suction line in the case that the oil returned to the compressors decreases below a predefined minimum level. According to this embodiment, if it is determined that there is a risk that the oil level in the compressors becomes too low at the current oil return level, it is necessary to select an option which ensures that sufficient oil is returned to the compressors. This may be done by ensuring that at least one compressor is connected to the medium pressure suction line, since this will ensure that the refrigerant supplied to this compressor returns oil to the compressor.

According to a second aspect the invention provides a vapour compression system comprising a compressor unit comprising one or more compressors, a heat rejecting heat exchanger, a high pressure expansion device, a receiver and at least one evaporator unit, each evaporator unit comprising an evaporator and an expansion device controlling a supply of refrigerant to the evaporator, each compressor of the compressor unit being connectable to a high pressure suction line and/or to a medium pressure suction line, the high pressure suction line interconnecting a gaseous outlet of the receiver and the compressor unit and the medium pressure suction line interconnecting an outlet of the evaporator unit(s) and the compressor unit, wherein the vapour compression system further comprises at least one valve arrangement arranged to selectively connect one of the compressors to the high pressure suction line or to the medium pressure suction line, the valve arrangement comprising a two-way valve arranged to connect the compressor to the high pressure suction line and a non-return valve arranged to connect the compressor to the medium pressure suction line.

It should be noted that a skilled person would readily recognise that any feature described in combination with the first aspect of the invention could also be combined with the second aspect of the invention, and vice versa. For instance, the method according to the first aspect of the invention may be performed on the compressor unit of the vapour compression system according to the second aspect of the invention. Thus, the remarks set forth above are equally applicable here.

The features of the vapour compression system according to the second aspect of the invention have already been described above. Since the vapour compression system comprises at least one valve arrangement comprising a two-way valve arranged to connect the compressor to the high pressure suction line and a non-return valve arranged to connect the compressor to the medium pressure suction line, it is possible to switch the compressor(s) from being connected to the high pressure suction line to being connected to the medium pressure suction line, or vice versa, without having to switch off the compressor(s). As described above, this ensures that the compressors can be switched fast, and the wear on the compressor(s) is minimised.

The high pressure expansion device may be an ejector having a primary inlet connected to an outlet of the heat rejecting heat exchanger, an outlet connected to the receiver and a secondary inlet connected to the medium pressure suction line. This has already been described above. Alternatively or additionally, the high pressure expansion device could include a high pressure valve.

The vapour compression system may further comprise a heat recovery heat exchanger arranged in the refrigerant path between an outlet of the compressor unit and an inlet of the heat rejecting heat exchanger. According to this embodiment, the vapour compression system is used for cooling purposes as well as for heating purposes, in that heat is recovered from the compressed refrigerant, by means of the heat recovery heat exchanger, before the refrigerant enters the heat rejecting heat exchanger. The recovered heat could, e.g., be used for heating domestic water and/or for room heating purposes.

It should be mentioned, that the method operating a compressor unit described above could also be applied to alternative kinds of compressor units, such as compressor units which are not forming part of a medium temperature (MT) suction group. For instance, the vapour compression system may comprise two or more MT suction levels (e.g. corresponding to −2° C. and −8° C. pressures, respectively). Alternatively or additionally, the vapour compression system may comprises an air condition (AC) suction level which is separate from the receiver pressure, but which is provided with a separate compressor unit. Alternatively or additionally, a heat pump evaporator may have its own suction level.

BRIEF DESCRIPTION OF THE DRAWINGS

The invention will now be described in further detail with reference to the accompanying drawing in which FIG. 1 is a diagrammatic view of a vapour compression system according to an embodiment of the invention.

DETAILED DESCRIPTION

FIG. 1 is a diagrammatic view of a vapour compression system 1 according to an embodiment of the invention. The vapour compression system 1 comprises a compressor unit 2, two heat recovery heat exchangers 3*a*, 3*b*, a heat rejecting heat exchanger 4, an ejector 5, a high pressure valve 6, a receiver 7 and one or more evaporator units (not shown), arranged in a refrigerant path. Each evaporator unit comprises an evaporator and an expansion device arranged to control a refrigerant supply to the evaporator.

The compressor unit 2 comprises a number of compressors 8, 9, 10, four of which are shown. One of the compressors 8 is permanently connected to a high pressure suction line 11 interconnecting a gaseous outlet 12 of the receiver 7 and the compressor unit 2. Another one of the compressors 9 is permanently connected to a medium pressure suction line 13 interconnecting an outlet of the evaporator units and the compressor unit 2. The last two compressors 10 are selectively connected to the high pressure suction line 11 or to the medium pressure suction line 13 via a valve arrangement 14, 15. One of the valve arrangements is in the form of a three-way valve 14, and the other valve arrangement 15 is in the form of a two-way valve 16 arranged to connect the compressor 10 to the high pressure suction line 11 and a non-return valve 17 arranged to connect the compressor 10 to the medium pressure suction line 13. When the two-way valve 16 is open, the compressor 10 is connected to the high pressure suction line 11, via the two-way valve 16. Simultaneously, the non-return valve 17 is closed, preventing that the compressor 10 receives refrigerant from the medium pressure suction line 13. When the two-way valve 16 is closed, a refrigerant supply to the compressor 10 from the high pressure suction line 11 is prevented. Instead, the non-return valve 17 is opened, thereby allowing the compressor 10 to receive refrigerant from the medium pressure suction line 13.

Accordingly, the compressor capacity represented by the compressors 10 can be shifted between being applied for compressing refrigerant received from the gaseous outlet 12 of the receiver 7, via the high pressure suction line 11, and being applied for compressing refrigerant received from the outlet(s) of the evaporator unit(s), via the medium pressure suction line 13. Since the two-way valve 16 can be switched between an open and a closed position without having to stop the compressor 10, this valve arrangement 15 allows a part of the compressor capacity to be switched between being connected to the high pressure suction line 11 and the medium pressure suction line 13, without having to stop the compressor 10. This allows the compressor capacity to be shifted fast and without inducing unnecessary wear on the compressors 10.

Refrigerant flowing in the refrigerant path is compressed by the compressors 8, 9, 10 of the compressor unit 2. Some of the refrigerant leaving the compressor unit 2 passes through high temperature heat recovery heat exchanger 3*a* as well as through low temperature heat recovery heat exchanger 3*b* before being supplied to the heat rejecting heat exchanger 4, and some of the refrigerant only passes through the low temperature heat recovery heat exchanger 3*b* before being supplied to the heat rejecting heat exchanger 4. The refrigerant passing through the high temperature heat recovery heat exchanger 3*a* is typically the refrigerant which was compressed by the compressors 9, 10 which are connected to the medium pressure suction line 13.

In the heat recovery heat exchangers 3*a*, 3*b*, heat exchange takes place between the refrigerant and a heat recovery system (not shown), in such a manner that heat is rejected from the refrigerant, i.e. the refrigerant is cooled. The heat recovery system may, e.g., be used for providing heating of domestic water and/or for room heating.

In the heat rejecting heat exchanger 4 heat exchange takes place between the refrigerant and the ambient, or with a secondary fluid flow across the heat rejecting heat exchanger 4, in such a manner that heat is rejected from the refrigerant. The heat rejecting heat exchanger 4 may be in the form of a condenser, in which case the refrigerant passing through the heat rejecting heat exchanger 4 is at least partly condensed. Alternatively, the heat rejecting heat exchanger 4 may be in the form of a gas cooler, in which case the refrigerant passing through the heat rejecting heat exchanger 4 is cooled, but remains in a gaseous or transcritical state.

The refrigerant leaving the heat rejecting heat exchanger 4 passes through either the ejector 5, via a primary inlet 18 of the ejector 5, or through the high pressure valve 6, before being supplied to the receiver 7. The refrigerant undergoes expansion when passing through the ejector 5 or the high pressure valve 6, and the refrigerant supplied to the receiver 7 is in a mixed liquid and gaseous state. In the receiver 7, the refrigerant is separated into a liquid part and a gaseous part. The liquid part of the refrigerant is supplied to the evaporator unit(s), where the refrigerant is expanded in the expansion device(s) before being supplied to the evaporator(s). In the evaporator(s) the refrigerant is at least partly evaporated, while heat exchange takes place with the ambient, or with a secondary fluid flow across the evaporator(s), in such a manner that heat is absorbed by the refrigerant. The refrigerant leaving the evaporator unit(s) is supplied to the medium pressure suction line 13.

At least some of the refrigerant flowing in the medium pressure suction line 13 may be supplied to the compressors 9, 10 being connected thereto. Furthermore, at least some of the refrigerant flowing in the medium pressure suction line 13 may be supplied to a secondary inlet 19 of the ejector 5.

The gaseous part of the refrigerant in the receiver 7 may be supplied to the high pressure suction line 11, via the gaseous outlet 12 of the receiver 7. The refrigerant flowing in the high pressure suction line 11 may be supplied to the compressors 8, 10 being connected thereto. Furthermore, the refrigerant flowing in the high pressure suction line 11 may be supplied to the medium pressure suction line 13, via a bypass valve 20

The vapour compression system 1 further comprises a low temperature compressor unit 21, comprising a number of low temperature compressors 22, two of which are shown. The low temperature compressor unit 21 typically forms part of a refrigerant circuit which provides low temperature cooling, e.g. for one or more freezers.

The outlets of the low temperature compressors 22 are selectively connectable to the high pressure suction line 11 or to the medium pressure suction line 13, via low temperature valve arrangements 23, 24. One of the low temperature valve arrangements is in the form of a three-way valve 23. The other one of the low temperature valve arrangement 24 comprises a two-way valve 25 and a non-return valve 26, similarly to the arrangement described above.

According to an embodiment of the invention, a number of options for distributing the available compressor capacity of the compressor unit 2 between being connected to the high pressure suction line 11 and to the medium pressure suction line 13 may be defined. The options may advantageously include various combinations of settings of the valve arrangements 14, 15, 23, 24.

For each of the options, an expected impact on one or more operating parameters of the vapour compression system 1, resulting from distributing the available compressor capacity according to the option, is predicted. For instance, the impact on energy efficiency of the vapour compression system 1, mass flow distribution in the vapour compression system 1, cooling capacity, wear on the compressors 8, 9, 10, oil return to the compressors 8, 9, 10, heat recovery, etc. may be taken into account, possibly in a prioritized manner.

Based on the predicted expected impact for the options, and on current operating demands for the vapour compression system 1, one of the available options is selected. For instance, the most energy efficient of the options which provide a required cooling capacity could be selected.

Finally, the available compressor capacity of the compressor unit 2 is distributed according to the selected option, i.e. the valve arrangements 14, 15, 23, 24 are set in accordance with the selected option. It should be noted that the settings of the low temperature valve arrangements 23, 24 distribute the discharge of the low temperature compressors 22 between the high temperature pressure suction line 11 and the medium pressure suction line 13. This may be used for ensuring that a sufficient refrigerant supply is available in each of these suction lines 11, 13.

It should be noted that the present invention also covers embodiments in which some of the components illustrated in FIG. 1 are omitted. For instance, the vapour compression system 1 may comprise only an ejector 5, the high pressure valve 6 being omitted, or the vapour compression system 1 may comprise only a high pressure valve 6, the ejector 5 being omitted.

Furthermore, none of the compressors 8, 9, 10 may be permanently connected to the high pressure suction line 11, and/or none of the compressors 8, 9, 10 may be permanently connected to the medium pressure suction line 13. Furthermore, all of the compressors 10 being selectively connected to the high pressure suction line 11 or to the medium pressure suction line 13 may be connected via three-way valves 14, or all of the compressors 10 may connected via valve arrangements 15 comprising a two-way valve 16 and a non-return valve 17.

Furthermore, the low temperature compressor unit 21 and/or the heat recovery heat exchanger 3 may be omitted.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for operating a compressor unit comprising one or more compressors, the compressor unit being arranged in a vapour compression system, the vapour compression system further comprising a heat rejecting heat exchanger, a high pressure expansion device, a receiver and at least one evaporator unit, each evaporator unit comprising an evaporator and an expansion device controlling a supply of refrigerant to the evaporator, each compressor of the compressor unit being alternately connectable to a high pressure suction line or to a medium pressure suction line, the high pressure suction line interconnecting a gaseous outlet of the receiver and the compressor unit and the medium pressure suction line interconnecting an outlet of the evaporator unit(s) and the compressor unit, wherein the vapour compression system further comprises at least one valve arrangement, each valve arrangement of the at least one valve arrangement being arranged to selectively connect one compressor of the one or more compressors to the high pressure suction line or to the medium pressure suction line, the method comprising the steps of:

defining two or more options for distributing the available compressor capacity of the compressor unit between compressors of the compressor unit being connected to the high pressure suction line and to the medium pressure suction line, for each option, predicting an expected impact on one or more operating parameters of the vapour compression system, resulting from distributing the available compressor capacity according to the option, selecting an option, based on the predicted expected impact for the options, and based on current operating demands of the vapour compression system, and distributing the available compressor capacity according to the selected option by switching one or more compressors from being connected to the medium pressure suction line to being connected to the high pressure suction line, or vice versa, by operating the at least one valve arrangement.

2. The method according to claim 1, wherein the step of switching one or more compressors is performed without stopping the compressor(s).

3. The method according to claim 2, wherein the step of distributing the available compressor capacity according to the selected option comprises switching one or more compressors of the compressor unit on or off.

4. The method according to claim 1, wherein the valve arrangement comprises a two-way valve arranged to connect the one compressor of the one or more compressors to the high pressure suction line and a non-return valve arranged to connect the one compressor of the one or more compressors to the medium pressure suction line.

5. The method according to claim 1, wherein the step of distributing the available compressor capacity according to the selected option comprises switching one or more compressors of the compressor unit on or off.

6. The method according to claim 1, wherein the one or more operating parameters of the vapour compression system comprises energy consumption, mass flow distribution, cooling capacity, heat recovery, number of starts or stops of compressors, runtime equalization of compressors, and/or oil return to the compressor unit.

7. The method according to claim 1, wherein the step of predicting an expected impact on one or more operating parameters of the vapour compression system is performed using a model based approach.

8. The method according to claim 1, wherein the step of selecting an option is further based on one or more expected future requirements for operating the vapour compression system, and wherein the step of distributing the available compressor capacity according to the selected option comprises switching a compressor which is currently not running from being connected to the high pressure suction line to being connected to the medium pressure suction line, or vice versa, in order to be able to meet the expected future requirements.

9. The method according to claim 1, wherein the vapour compression system further comprises a low temperature evaporator unit, a low temperature compressor unit having an inlet connected to an outlet of the low temperature evaporator unit, and a low temperature valve arrangement arranged to selectively interconnect an outlet of the low temperature compressor unit to the high pressure suction line or to the medium pressure suction line, wherein at least some of the options define settings for the low temperature valve arrangement.

10. The method according to claim 9, wherein the step of distributing the available compressor capacity comprises operating the low temperature valve arrangement.

11. The method according to claim 1, wherein the step of defining two or more options for distributing the available compressor capacity is performed on the basis of current and/or expected operating conditions of the vapour compression system.

12. The method according to claim 1, wherein the high pressure expansion device is an ejector having a primary inlet connected to an outlet of the heat rejecting heat exchanger, an outlet connected to the receiver and a secondary inlet connected to the medium pressure suction line, and wherein the method further comprises the step of monitoring oil return to the compressors.

13. The method according to claim 12, wherein the step of selecting an option comprises selecting an option in which at least one compressor is connected to the medium pressure suction line in the case that the oil returned to the compressors decreases below a predefined minimum level.

14. A vapour compression system comprising a compressor unit comprising a plurality of compressors, a heat rejecting heat exchanger, a high pressure expansion device, a receiver and at least one evaporator unit, each evaporator unit comprising an evaporator and an expansion device controlling a supply of refrigerant to the evaporator, each compressor of the compressor unit being alternately connectable to a high pressure suction line and to a medium pressure suction line, the high pressure suction line interconnecting a gaseous outlet of the receiver and the compressor unit and the medium pressure suction line interconnecting an outlet of the evaporator unit(s) and the compressor unit, wherein the vapour compression system further comprises at least one valve arrangement arranged to selectively connect one of the compressors to the high pressure suction line or to the medium pressure suction line, the valve arrangement comprising a two-way valve arranged to connect the compressor to the high pressure suction line and a non-return valve arranged to connect the compressor to the medium pressure suction line.

15. The vapour compression system according to claim 14, wherein the high pressure expansion device is an ejector having a primary inlet connected to an outlet of the heat rejecting heat exchanger, an outlet connected to the receiver and a secondary inlet connected to the medium pressure suction line.

16. The vapour compression system according to claim 14, further comprising a heat recovery heat exchanger arranged in the refrigerant path between an outlet of the compressor unit and an inlet of the heat rejecting heat exchanger.

* * * * *